US008098789B2

(12) United States Patent
Nye et al.

(10) Patent No.: US 8,098,789 B2
(45) Date of Patent: Jan. 17, 2012

(54) SYSTEMS AND METHODS FOR THE CYCLOTRON PRODUCTION OF IODINE-124

(75) Inventors: Jonathon Andrew Nye, Decatur, GA (US); Robert Jerome Nickles, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 820 days.

(21) Appl. No.: 11/223,238

(22) Filed: Sep. 9, 2005

(65) Prior Publication Data

US 2007/0064858 A1 Mar. 22, 2007

(51) Int. Cl.
*G21G 1/10* (2006.01)

(52) U.S. Cl. ..... 376/190; 376/194

(58) Field of Classification Search ..... 376/190, 376/194

See application file for complete search history.

(56) References Cited

U.S. PATENT DOCUMENTS 2,504,585 A * 4/1950 Reid ..... 376/199
4,088,532 A * 5/1978 Blue ..... 376/198
5,019,323 A * 5/1991 Lambrecht et al. ..... 376/201

OTHER PUBLICATIONS

Schlyer, D. J. "Production of Radioactive Iodine." Technical Meeting of Project Counterparts on Cyclotron Production of Iodine-123, Institute of Nuclear and Energy Research. BNL-68599. Aug. 8, 2001. pp. 1-14, plus 2 pages showing citation information.*

N.G. Van Kampen, "Stochastic Processes in Physics and Chemistry", North-Holland Personal Library, North-Holland Publishing Co., Amsterdam 1987; especially, Chapter VII: "Chemical Reactions", pp. 188-190.*

"Physical Constants of Inorganic Compounds", from Chapter 4 in CRC Handbook of Checmistry and Physics, Ed. David R. Lide, Taylor & Francis (Boca Raton, USA), 86$^{th}$ Edition, 2005-2006; pp. 4-46 and 4-65 (for aluminum telluride and hydrogen telluride, resp.).*

Presentation at 5$^{th}$ International Symposium on Radiohaolgens, J.A. Nye and R.J. Nickles, Strategies in Choosing Binary Alloys for the Production of I-124 Proof-of-Principle studies using $Al_2$+$Te_3$, Sep. 12, 2004.

S. Prakash, S. Asokan, and D B Ghare, Electrical Switching Behaviour of Semiconducting Aluminium Telluride Glasses, Semicond. Sci. Technol., vol. 9 (1994), pp. 1484-1488.

Y. Sheh, J. Koziorowski, J. Balatoni, C. Lom, J.R. Dahl, and R. D. Finn, Low Energy Cyclotron Production and Chemical Separation of "No Carrier Added" Iodine-124 from a Reusable, Enriched Tellurium-124 Dioxide/Aluminum Oxide Solid Solution Target, Radiochim. Acta 88, ppl. 169-173, 2000.

S. M. Qaim, A. Hohn, Th. Bastian, K. M. El-Azoney, G. Blessing, S. Spellerberg, B. Scholten, H. H. Coenen, Some Optimisation Studies Relevant to the Production of High-Purity $^{124}$I and $^{120g}$I at a Small-Sized Cyclotron, Applied Radiation and Isotopes, vol. 58, pp. 69-78, 2003. Page print of http://mtech.edu/chem/syllabi/CHEM_330/Reactions/Handbo... dated Nov. 9, 2005.

* cited by examiner

*Primary Examiner* — Johannes P Mondt
(74) *Attorney, Agent, or Firm* — Bell & Manning, LLC

(57) ABSTRACT

The present invention relates to targets, systems and methods for the cyclotron production of $^{124}$I from aluminum telluride ($Al_2Te_3$) targets. The systems and methods utilize low energy proton cyclotrons to produce $^{124}$I by the $^{124}$Te(p,n) reaction from enriched $Al_2Te_3$ glassy melts. The $^{124}$I is recovered in high yield from the glassy melt by adapted methods of common thermal distillation techniques.

14 Claims, 4 Drawing Sheets

SYSTEMS AND METHODS FOR THE CYCLOTRON PRODUCTION OF IODINE-124

STATEMENT OF GOVERNMENT RIGHTS

Research funding was provided for this invention by the DOE under grant number DE-FG07-01/D14107. The United States government has certain rights in this invention.

FIELD OF THE INVENTION

This invention relates to improved systems and methods for the cyclotron production of $^{124}I$ using an aluminum telluride ($Al_2Te_3$) target.

BACKGROUND OF THE INVENTION

Positron emission tomography (PET) plays a vital role in the diagnosis of health and disease. Over the last half decade, steady advancements in PET instrumentation and synthetic chemistry have required substantial quantities of the cyclotron produced positron emitting isotopes, $^{11}C$, $^{13}N$, $^{15}O$, and $^{18}F$. Carbon, nitrogen and oxygen offer the advantage of seamless integration into existing compounds without altering their chemical properties. $^{18}F$ labeled compounds, as analog species, mimic many natural substances but fail to completely navigate most biochemical pathways. However, the favorable half-life of $^{18}F$ ($t_{1/2}$=109 min) proves to be well suited for most time scales explored in the body.

The value of PET, well represented by the wide use of [$^{18}F$]-fluorodeoxyglucose ([$^{18}F$]-FDG) in the clinical environment, bridges cardiology, oncology and the neurosciences. Within the last decade, a significant percentage of new PET installations have occurred at oncology sites for the diagnosis and staging of disease as well as monitoring the progression of treatment regimens. Another major consumer of fluorinated agents, including [$^{18}F$]-FDG, has developed within the pharmaceutical companies. Coinciding with the arrival of commercial small animal scanners, monitoring drug behavior on the tracer level in vivo has proven more effective than observing indirect responses in large patient demographics.

A natural outcome of the increasing clinical [$^{18}F$]-FDG studies in the late 1990s was the birth of commercial PET isotope distribution centers. CTI installed the first commercial purpose cyclotron in 1990 which has proliferated to nearly 150+11 MeV RDS proton (only) cyclotrons nationwide. These distribution centers operate with a capacity that has changed the architecture of medical imaging centers. The formation of satellite imaging facilities is now realized as long as a host cyclotron falls within a driving radius on the order of the labeled half-life. However, geography has limited these sites to providing only $^{18}F$, as the positron emitting isotopes of oxygen, nitrogen, and carbon have short half-lives that do not lend themselves to transport over long distances (>few kilometers).

The freedom to label authentic ligands, native to the body's physiological environment, forces the expansion of PET beyond the pure positron emitters stressing development of production systems for non-conventional PET isotopes. Much of the growing need for these non-conventional isotopes focuses on the long-lived neutron deficit radiohalogens, specifically $^{124}I$ ($t_{1/2}$=4.17d, $E_{\beta+}$=2.13 MeV, $I_{\beta+}$=22%, $\gamma$=603 keV). The incorporation of radiohalogens into organic molecules is supported by a vast body of literature recently reviewed (Bolton. J. Label. Compd. Radiopharm., 45, 485 (2002); Adam et al., Chem. Soc. Rev., 34, 153 (2004)). The promising clinical aspects of $^{124}I$ have led to investments among several research institutions and commercial companies to produce multi-mullicurie quantities for distribution purposes. The combination of physiological versatility and well-known labeling chemistry ensures a pivotal role for $^{124}I$ in developing molecular agents of diagnostic and therapeutic value.

Traditionally, the bulk output of radiohalogens, including $^{124}I$, comes from a few centers with large multi-particle cyclotrons (i.e. 30 MeV protons, 15 MeV deuterons) driving the $^{124}Te(d, 2n)^{124}I$ reaction (Sharma et al., J. Lab. Compd. Radiopharm., 2, 17 (1969); Lambrecht et al., J. Radioanal. Nucl. Chem. Letters, 127, 143 (1988); and Firouzbakht et al., Nicl. Insrtum. Meth. Phys. Research, B79, 909 (1993)). However, a large population of low energy biomedical cyclotrons have benefited from the moderate yields of the $^{124}Te(p,n)^{124}I$ pathway (Scholten et al., Appl. Radiat. Isot., 46, 255 (1995)). The high radionuclidic purity and modest contributions from the secondary $^{124}Te(p,2n)^{123}I$ reaction present attractive aspects for targetry development along this path. Thus, the large commercial presence of these biomedical cyclotrons, distributed across the United States (i.e. 11 MeV CTI RDS; 16 MeV GE PETtrace), normally supplying curie quantities of [$^{18}F$]-FDG, provide an appropriate base for a steady source of $^{124}I$. Unfortunately, efforts to produce this radiohalogen have generally gone undeveloped. A combination of factors have prevented expansion, centering primarily on the complexity of the target systems, expense of the enriched substrates, low reaction yields, and extensive post-processing to reclaim the target material.

It is known that elemental tellurium does not possess the necessary thermal and physical properties for a stable solid matrix needed in the harsh irradiation conditions of a cyclotron target. In addition, separation of the $^{124}I$ product from the packed target powder requires wet chemistry techniques, making post-processing arduous. Pairing tellurium with a low-Z element, forming a binary compound, significantly improves the thermal performance and physical nature of target material. The preferred method involves the irradiation of binary compounds, specifically tellurium dioxide ($TeO_2$) and copper telluride ($Cu_2Te$). The bombardment of glassy tellurium dioxide melts has prevailed as the material of choice given its high mass fraction and commercial availability. The added benefit of dry distillation to recover the $^{124}I$ product proves more favorable for $TeO_2$ as each thermal cycle leaves the target in a preparative state for the next irradiation.

Development of a reliable methodology to produce $^{124}I$ on low energy cyclotrons is largely discouraged in the literature but sufficient amounts have been demonstrated on 13 MeV machines using conventional targets (McCarthy et al., Proceedings of the 8$^{th}$ Workshop on Targetry and Target Chemistry, St. Louis, Mo., 127 (1999); Sheh et al., Radiochem. Acta, 88, 169 (2000); and Qaim et al., Appl. Radiat. Isot., 58, 69 (2003). Using the existing systems and targets, obtaining useful quantities of $^{124}I$ via the (p,n) reaction at proton energies below 13 MeV becomes difficult as the saturation yield drops by nearly a factor of three from an incident energy of 13 to 11 MeV. In addition, commitment to the required startup costs overwhelms most PET sites interested in $^{124}I$ research. Thus, a need exists for an improved system and target material for the production of $^{124}I$ utilizing low energy biomedical cyclotrons.

SUMMARY OF THE INVENTION

The present invention provides systems and methods for producing batch quantities of $^{124}I$ on a cyclotron using an aluminum telluride target.

The present invention was based, at least in part, on a strategy of enhancing the physical properties of a target by pairing elemental tellurium with a light element led to provide an alternative substrate for $^{124}I$ production. For a binary combination, $M_x{}^{124}Te_y$, the pairing species, $M_x$, depends ultimately on the desired characteristics of the resultant compound. In the development of the present invention, the inventors identified several desired characteristic for the binary combination. The binary combination is preferably easily made in a common chemistry lab. Pairing an element low in stopping power (low Z, small x) will keep the mass fraction of tellurium high. An increase in melting point, resulting from the pairing, generally signals a low vapor pressure, desirable for solid compounds. Perhaps the most important characteristic of the binary compound is its ability to release iodine more readily at a reasonable temperature, normally referenced at the material's melting point. Based on these desired characteristics, the inventors have identified aluminum telluride ($Al_2Te_3$) as a superior target material for the cyclotron production of $^{124}I$.

In its basic embodiment, the present invention provides a system and method whereby an aluminum telluride target, preferably highly enriched with $^{124}Te$, is irradiated with protons on a cyclotron, preferably a lower energy cyclotron, to produce the positron emitting iodine isotope $^{124}I$ in the target, via the $^{124}Te(p,n)$ reaction, of which the activity is released from the target and collected in a high yield.

In an alternative embodiment, comprising the same system and method, an aluminum telluride target, preferable highly enriched with $^{124}Te$, is irradiated with deuterons on a cyclotron, to produce the positron emitting iodine isotope $^{124}I$ in the target, via the $^{124}Te(d,2n)$ reaction, of which the activity is released from the target and collected in high yield. The required target encasement and level of $^{124}Te$ enrichment follow those guidelines established for $^{124}I$ production by way of proton irradiation of an aluminum telluride target.

In some embodiments, the systems and methods provide at least 80% release of the $^{124}I$ from the target. This includes embodiments which provide at least 85% release of $^{124}I$ from the target, at least 90% release of $^{124}I$ from the target and at least 95% release of $^{124}I$ from the target. As a result, the present methods and systems are able to provide $^{124}I$ in commercially useful quantities.

The cyclotron production of $^{124}I$ may be carried out on any one of the many low energy cyclotrons that are scattered throughout the United States at various academic and commercial locations. These biomedical cyclotrons typically irradiate targets with protons at energies of about 18 MeV or less. This includes cyclotrons that are adapted to irradiate a target at proton energies of about 16 MeV or less and further includes cyclotrons that are adapted to irradiate a target at proton energies of about 11 MeV or less.

An analogous process for the production of $^{124}I$ may be carried out at any cyclotron site with the capability of irradiating targets with deuterons at energies of about 30 MeV or less. This includes cyclotrons that are adapted to irradiate targets at energies of about 15 MeV or less and further includes cyclotrons that are adapted to irradiate a target at deuteron energies of about 7 MeV or less.

Further objects, features and advantages of the invention will be apparent from the following detailed description when taken in conjunction with the accompanying drawings.

DETAILED DESCRIPTION OF THE INVENTION

Figure 1:
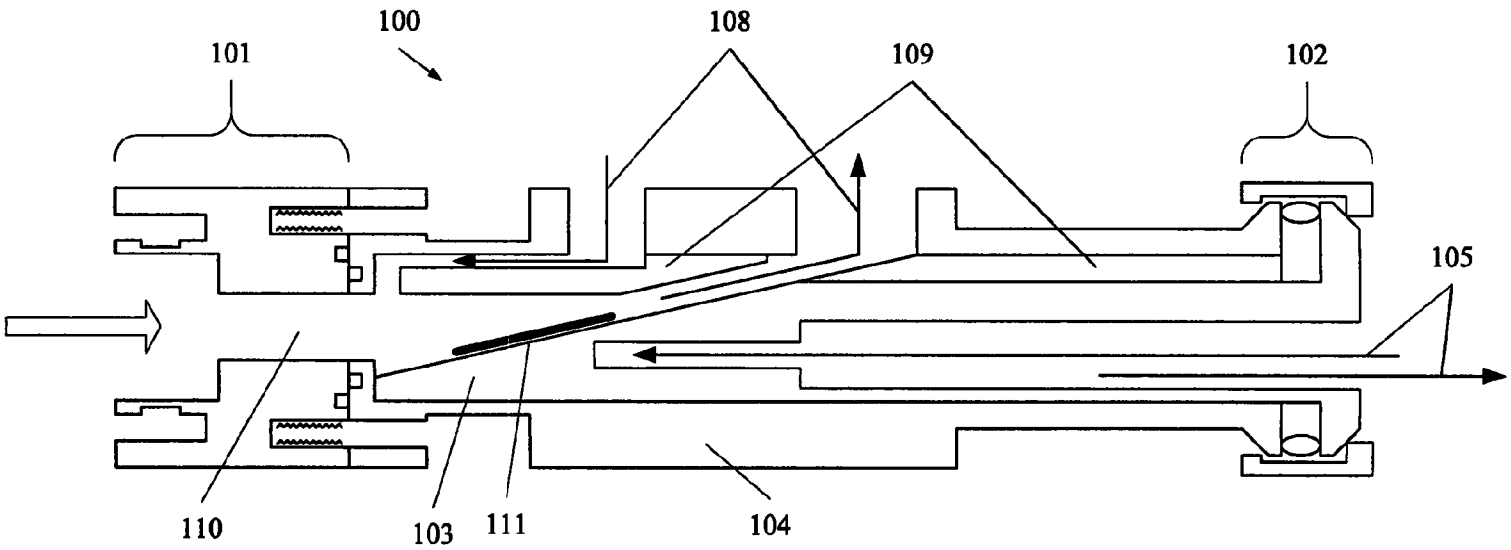
FIG. 1 is a schematic diagram of an apparatus for the cyclotron production of $^{124}I$. The apparatus includes a 20-degree inclined solid target.

The present invention provides novel aluminum telluride targets for use in the low energy cyclotron production of $^{124}I$ and to cyclotron systems and methods that utilize the aluminum telluride targets. The description that follows provides a non-limited example of a method for the production of an aluminum telluride target and a non-limiting example of a system and method that may be used to produce $^{124}I$ from the target.

Aluminum Telluride Synthesis and Target Preparation

Tellurium (Te) metal has eight stable isotopes ($^{120}Te$, $^{122}Te$, $^{123}Te$, $^{124}Te$, $^{125}Te$, $^{126}Te$, $^{128}Te$, and $^{130}Te$) with $^{124}Te$ making up 4.6% of the natural abundance in nature. Production of $^{124}I$ by way of the (p,n) nuclear reaction requires tellurium enriched in $^{124}Te$ (i.e., tellurium that has been enriched through human intervention) to minimize contributions from long-lived contaminants. These contaminates result from reactions with improperly enriched $^{124}Te$ compounds containing traces of $^{125}Te$ and $^{126}Te$ ($^{125}Te(p,n)\,^{125}I$, $t_{1/2}$=59 d, $\gamma$=35 keV and $^{126}Te(p,n)\,^{126}I$, $t_{1/2}$=13d, $\gamma$=666 keV). Thus, the present targets are desirably highly enriched in $^{124}Te$. For example, the tellurium in the target may contain at least about 90% $^{124}Te$, more desirably, at least about 95% $^{124}Te$ and, still more desirably, at least about 99% $^{124}Te$.

Starting with enriched tellurium, the synthesis of aluminum telluride was in accordance with published procedure first described by Whitehead and later by Brauer (C. Whitehead, J. Amer. Chem. Soc. 17, 849 (1895); G. Brauer. Handbook of Preparative Inorganic Chemistry, Academic Press, New York, 1963, p. 826), the entire disclosures of which are incorporated herein by reference. Briefly, the preparation of aluminum telluride follows the stoichiometric relationship $2Al+3Te \rightarrow Al_2Te_3$. The correct proportions of aluminum powder and tellurium powder were weighed and placed in a quartz tube closed at one end. (i.e., 262 mg 99.5% $^{124}Te$ and 38 mg Al to produce 300 mg $Al_2{}^{124}Te_3$). A second quartz tube, lowered into the reaction vessel, provided a slow nitrogen gas flow (100 mL/min) over the top of the mixed powders. The entire assembly fit into a 1000° C. furnace used to carryout the reaction. The reaction took place over three separate points during the heating cycle. The first set point, 400° C., was well below the threshold to drive the reaction but allowed any trapped moisture to escape the admixture. After ten minutes the temperature was increased to 750° C. at which the exothermic reaction took place, signaled by a brief sound indicating the formation of aluminum telluride. The last temperature point, at 850° C., was held for one hour to anneal the product ensuring a complete reaction. Following the annealing phase, the quartz vessel was allowed to cool and cracked open to recover the aluminum telluride product. For a 300 mg aluminum/tellurium admixture, approximately 65-75 % of the solid aluminum telluride product was recovered and stored under an inert atmosphere. In this example, an amount of 203 mg of $Al_2{}^{124}Te_3$ was recovered.

In preparing a target, 200 mg of $Al_2{}^{124}Te_3$ was weighed, placed in a crucible and heated slowly to 910° C. under a 20 mL/min nitrogen flow. The preferred crucible can have any material composition that is chemically inert to the aluminum telluride compound over the temperature range needed to prepare the target. Examples of suitable materials include, but are not limited to, platinum, aluminum oxide, carbon, gold and tantalum. For this example, platinum was chosen for the target crucible. The furnace was kept at 910° C. for 10 minutes to ensure the target had completely melted. The cooled product formed a black glassy matrix distributed evenly over the platinum crucible. Losses during this cycle were less than 2%.

Target Design and Irradiation.

FIG. 1 shows a schematic diagram of an apparatus 100 that may be used to house the target during the cyclotron production of $^{124}I$. The apparatus includes a 20-degree inclined cooling stage 103 cut into an aluminum 6061-T6 rod which supports the platinum crucible 111 holding the target during irradiation. A 0.12 mm depression machined in the beam strike area of the stage receives a 0.25 mm thick indium foil that aids in conduction of heat to the cooling water 105 flowing through the aluminum stage. The platinum crucible, indium foil, and aluminum stage are compressed with an aluminum helium flow diverter 109 forming a 30 mm diameter plug encompassing the target material except for the beam path area. The target assembly mates to an aluminum casing 104 via a NW40 KF clamp 102 (MDC, Hayward, Calif.) for quick removal at the end of bombardment. A single 25.4 μm aluminum entrance foil 110, supported on a vacuum flange 101, isolates the casing and concentric cooling stage from the cyclotron vacuum. A circulating flow of chilled helium 108 feeds the casing at 180 L/min with an inlet temperature of 0° C.

Figure 2:
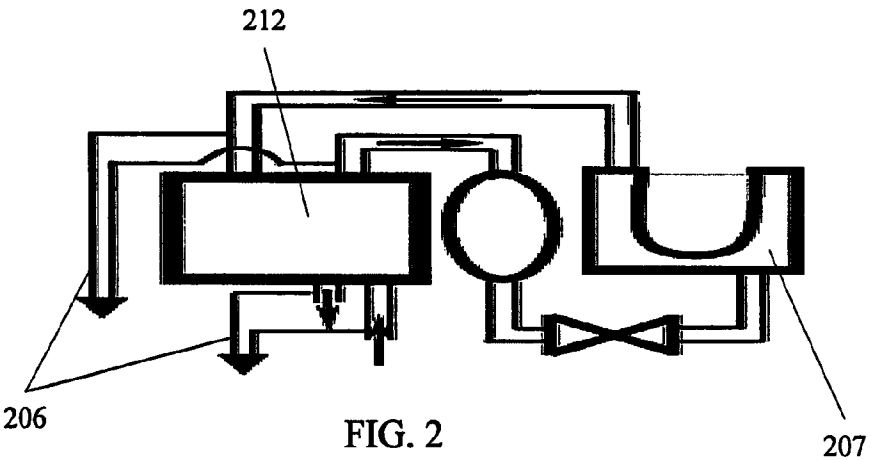
FIG. 2 is a schematic diagram of a target assembly, including a chilled helium heat exchanger, for the apparatus of FIG. 1.

FIG. 2 shows a diagram of the target assembly used to provide chilled helium. As shown in FIG. 2, beam power is removed from the helium stream by a heat exchanging system consisting of a double walled six liter stainless steel bucket 207 filled with dry ice. Thermocouples at the inlet/outlet positions of the helium cavity 206 measure the convective power removed from the target 212 surface. Similarly, thermistors 206 monitor the temperature rise in the cooling water supplied to the inclined cooling stage.

The irradiation was performed on an 11 MeV CTI RDS 112 cyclotron by slowly increasing the beam current to the desired value. Given the description of the embodiment above, the aluminum telluride target tolerates beam currents of up to at least 20 μA. The incident protons dissipate their entire energy in the target material. Saturation yields measured from the target were 229±18 μCi/μA-hr representing 95% of the thick target yield for the binary compound. Temperature differences between the inlet/outlet chilled helium streams show that approximately 30% of the beam power is carried away by convective cooling of the target face. Typically bombardment durations of two hours at 18 μA yield 8 mCi of $^{124}I$ in-target. Mass losses of the aluminum telluride melt are <1% per irradiation determined by an analytical scale.

The embodiment described above for the proton irradiation of aluminum telluride may be adapted to provide $^{124}I$ via deuteron irradiation of aluminum telluride targets. For example, a 16 MeV deuteron particle incident on the aluminum telluride detailed above would deposit the same amount of energy as a proton of 16 MeV. Differences in cross-sections between the $^{124}Te(p,n)^{124}I$ and $^{124}Te(d,2n)^{124}I$ pathways will result in different yields of $^{124}I$ at the end of bombardment. However, for all practical purposes, the target material behaves in the same fashion as with proton irradiation. Recovery of iodine from deuteron irradiated aluminum telluride targets follows the same procedures described for proton irradiation detailed below.

Post Processing and Recovery of $^{124}I$

Figure 3:
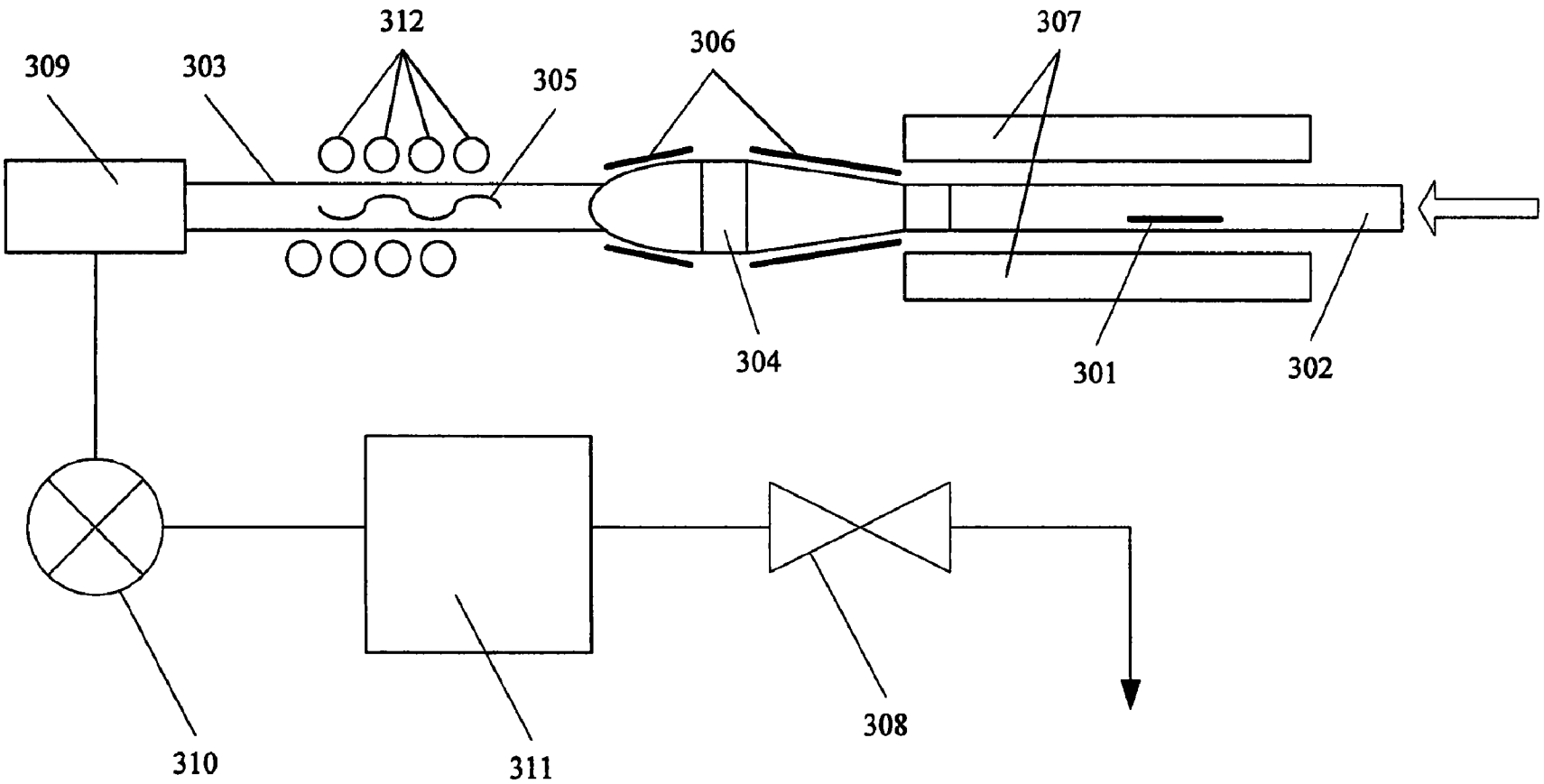
FIG. 3 shows a distillation system for the recovery of $^{124}I$ from a glassy aluminum telluride target.

The $^{124}I$ may be separated from the glassy melt using conventional dry distillation techniques. Such techniques are described in Van Den Bosch et al., Int. J. Appl. Rad. Isot., 28, 255 (1977); Beyer et al., Radiochem. Radioanal. Lett., 47, 151 (1981); and Beyer et al., Radiochim. Acta, 88, 175 (2000), the entire disclosures of which are incorporated herein by reference. In the present example, the distillation apparatus shown in FIG. 3 includes a compact furnace 307 lined with a 19 mm ID quartz tube 302 which supports a platinum crucible 301 during the thermal cycle. A 1 mm ID capillary section 303, treated with 20 mM ammonium hydroxide ($NH_4OH$), mates with the quartz tube via 24/40 grindings 304 at the furnace aperture. A 0.12 mm platinum wire 305 rinsed with 20 mM $NH_4OH$ was placed inside the quartz capillary section 303 to increase surface area and promote trapping of the volatilized iodine.

The platinum crucible was assayed and placed in the quartz furnace initially at room temperature. Heat tape 306, wrapped around the 24/40 grindings prevented premature plate out of the iodine before it reached the capillary section. The separation procedure starts by raising the furnace temperature to 400° C. for 10 minutes under a 20 mL/min dry air flow, adjusted by a needle valve 310 and monitored by a mass flow meter 311. Dry air was drawn through the assembly by a mini-pump 308 (KNF, West Chester, Pa.). A 400° C. furnace temperature allowed trapped moisture within the target material and furnace assembly to escape the distillation apparatus preventing condensation from plugging the capillary section during the recovery phase.

Figure 4:
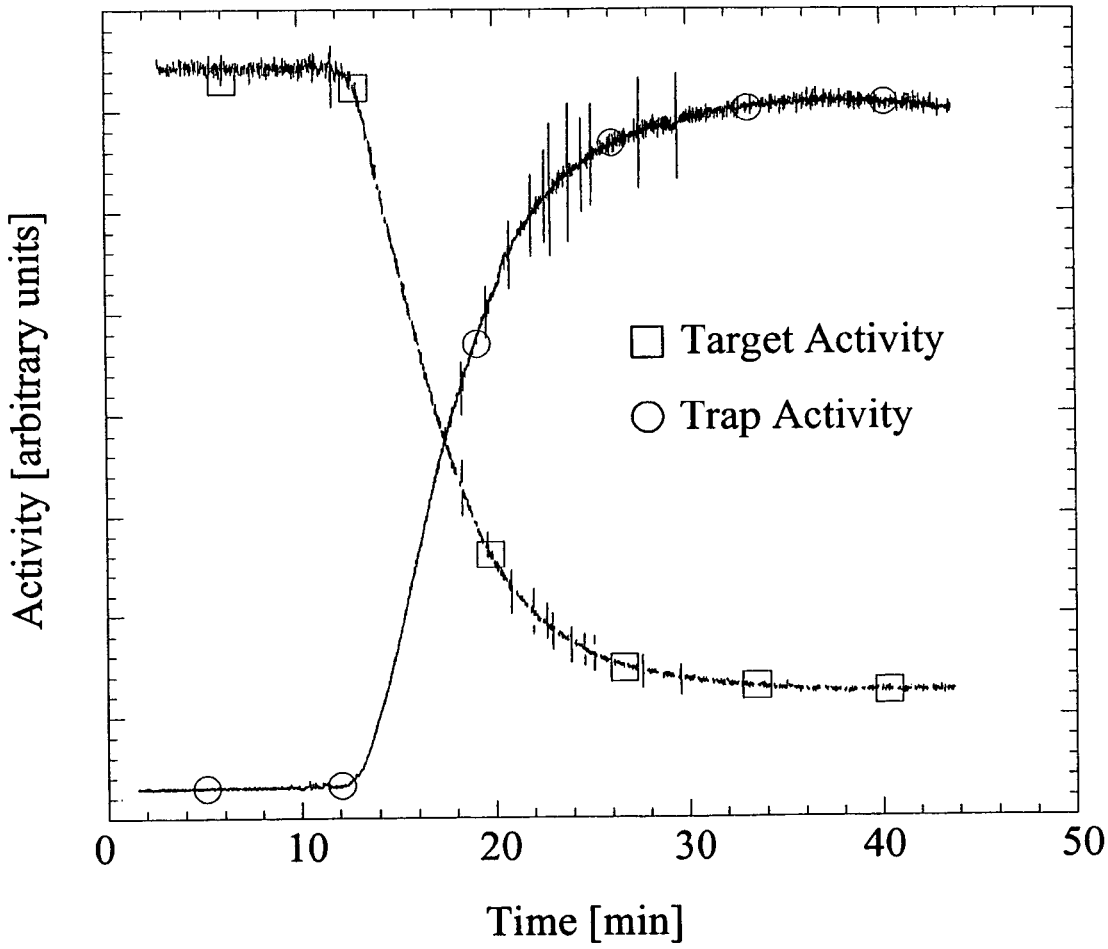
FIG. 4 shows a thermal chromatogram of $^{124}I$ release from an aluminum telluride target at 910° C.

Following the 400° C. set point, the capillary section was chilled with dry ice 312 while the furnace temperature was raised to 910° C. over a period of three minutes. Two 12×10 mm YAP (yttrium aluminum perovskite) detectors monitored the release of iodine from the aluminum telluride melt and subsequent trapping on the platinum loaded capillary section. The thermal chromatogram of FIG. 4 shows maximum release of the $^{124}I$ from the glassy melt after a period of approximately 15 minutes. At least about 95% of the activity was trapped downstream on the cooled quartz with about 5% remaining in the target as measured by a dose Capintec calibrator.

Figure 5:
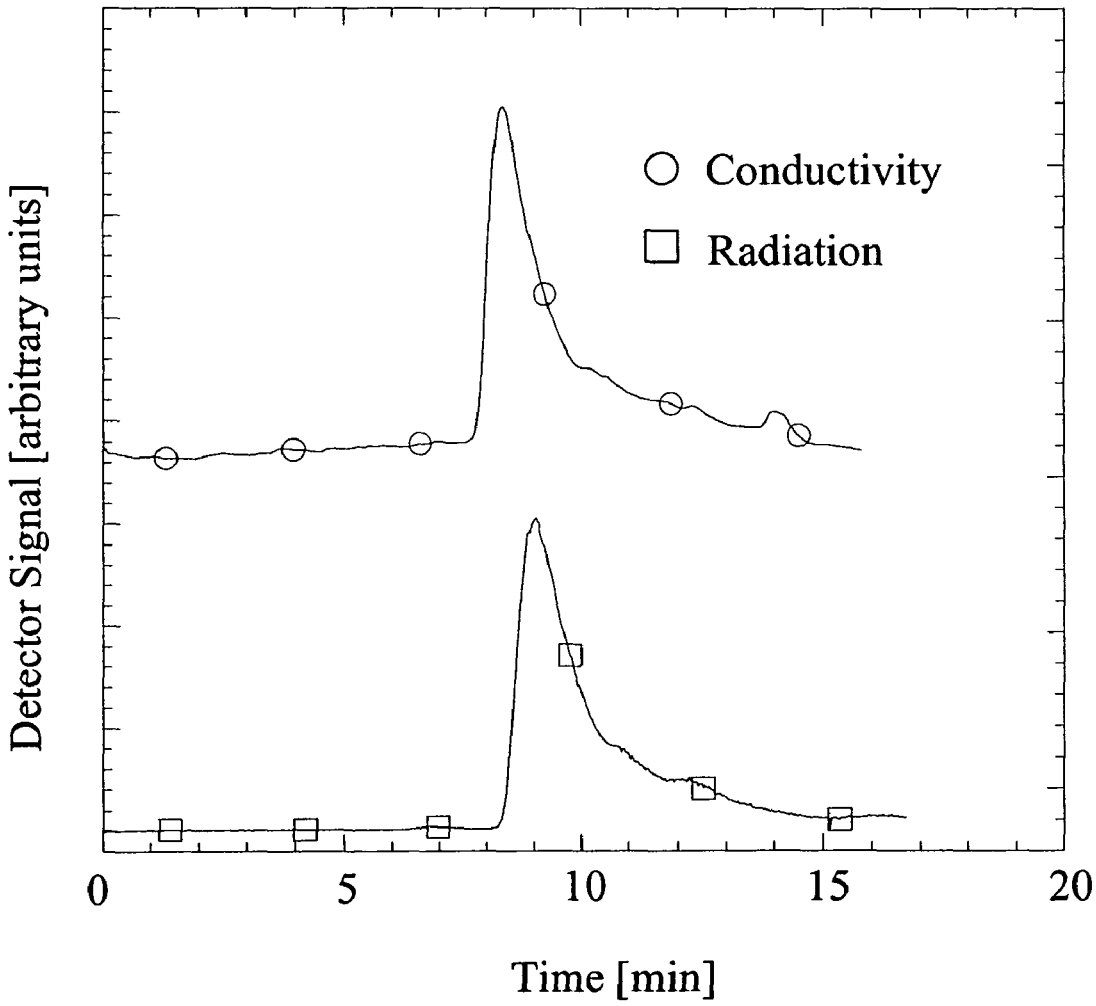
FIG. 5 shows an ion chromatogram of [$^{124}I$]-iodide injected on an Allsep anion column; eluent: 4 mM phthalic acid/KOH pH 4.0 at 1.2 mL/min.

Removal of $^{124}I$ from the capillary section exceeded 95% in a wash of warm 20 mM $NH_4OH$ buffer solution. Single column ion chromatography (SCIC) provided good separation of the iodate ($IO_3^-$) and iodide ($I^-$) species present in the distilled product. An eluent consisting of 4 mM phthalic acid, adjusted to pH 4.0 with lithium hydroxide, was equilibrated on an Allsep anion column (Alltech Associates, Deerfield, Ill.). Retention volumes for iodate and iodide were 1.5 mL and 9 mL for a standard injection of 260 ppm potassium iodate and 20 ppm potassium iodide, measured by conductivity. The ion chromatogram of FIG. 5 shows >99% of the distilled product in the iodide form. Recovered iodine supported in basic buffer solutions remained in the iodide form over a period of weeks.

It is understood that the invention is not confined to the particular embodiments set forth herein, but embraces all such forms thereof as come within the scope of the following claims.

What is claimed is:

1. A target material for the production of 124I comprising 124Te-enriched aluminum telluride.

2. The target material of claim 1 wherein the tellurium in the target material comprises at least about 95 atomic % 124Te.

3. The target material of claim 1 wherein the tellurium in the target material comprises at least about 99 atomic % 124Te.

4. The target material of claim 1 further comprising a support onto which the 124Te-enriched aluminum telluride is placed.

5. A system for the cyclotron production of 124I comprising a cyclotron, housing the target material of claim 1.

6. The system of claim 5, wherein the cyclotron is adapted to direct protons having an energy of no more than 18 MeV at the target material.

7. The system of claim 5 wherein the cyclotron is adapted to direct protons having an energy of no more than about 11 MeV at the target material.

8. The target material of claim 1 comprising at least 65 mass percent of the compound $Al_2{}^{124}Te_3$.

9. The target material of claim 1 comprising at least 75 mass percent of the compound $Al_2{}^{124}Te_3$.

10. The target material of claim 1, wherein the target material consists of aluminum telluride, and further wherein the tellurium in the target material comprises at least 90 atomic percent 124Te.

11. The target material of claim 1, wherein the target material is characterized in that the irradiation of 200 mg of the target material with protons for 2 hours at 18 μA yields at least 8 mCi of $^{124}I$ from the 124Te-enriched aluminum telluride in the target material.

12. The target material of claim 1, wherein the target material comprises at least 200 mg of aluminum telluride.

13. The target material of claim 1, further comprising a crucible comprising a material that is chemically inert to aluminum telluride, wherein the aluminum telluride is in contact with the material.

14. The target material of claim 1, wherein the aluminum telluride is present in a quantity sufficient to dissipate the energy of incident protons in a cyclotron beam having a current of 20 μA.

* * * * *